US011779134B2

(12) United States Patent
Lennon

(10) Patent No.: US 11,779,134 B2
(45) Date of Patent: Oct. 10, 2023

(54) DOOR ARRANGEMENT FOR REFRIGERATED MERCHANDISING CABINET

(71) Applicant: Orrell Limited, Dublin (IE)

(72) Inventor: Eoin Lennon, Kilmurry (IE)

( * ) Notice: Subject to any disclaimer, the term of this patent is extended or adjusted under 35 U.S.C. 154(b) by 277 days.

(21) Appl. No.: 17/004,184

(22) Filed: Aug. 27, 2020

(65) Prior Publication Data

US 2021/0059433 A1 Mar. 4, 2021

(30) Foreign Application Priority Data

Aug. 27, 2019 (GB) ..... 1912269

(51) Int. Cl.

| | |
|---|---|
| ***A47F 3/04*** | (2006.01) |
| ***F25D 21/04*** | (2006.01) |
| ***F25D 23/06*** | (2006.01) |
| ***F25D 23/08*** | (2006.01) |

(52) U.S. Cl.

CPC ..... *A47F 3/043* (2013.01); *A47F 3/0434* (2013.01); *F25D 21/04* (2013.01); *F25D 23/065* (2013.01); *F25D 23/087* (2013.01); *F25D 2201/122* (2013.01); *F25D 2400/06* (2013.01)

(58) Field of Classification Search

CPC ..... A47F 3/043; A47F 3/0434; A47F 3/04; F25D 21/04; F25D 23/065; F25D 23/087; F25D 2400/06

See application file for complete search history.

(56) References Cited

U.S. PATENT DOCUMENTS

| | | | | |
|---|---|---|---|---|
| 4,852,303 | A | 8/1989 | Rolek | |
| 5,255,473 | A | 10/1993 | Kaspar et al. | |
| 5,289,657 | A * | 3/1994 | Kiel | F25D 23/082 49/478.1 |
| 5,953,929 | A * | 9/1999 | Bauman | F25D 21/14 62/448 |
| 6,301,913 | B1 | 10/2001 | Schulak et al. | |

(Continued)

FOREIGN PATENT DOCUMENTS

| | | | |
|---|---|---|---|
| CN | 102379580 | B | 1/2014 |
| EP | 1908376 | A2 | 4/2008 |
| JP | 2017127352 | A | 7/2017 |

OTHER PUBLICATIONS

Search Report for European Patent Application No. 20193150 by European Patent Office dated Dec. 17, 2020.

(Continued)

*Primary Examiner* — Lionel Nouketcha

(74) *Attorney, Agent, or Firm* — Michael Crilly, Esquire

(57) ABSTRACT

A refrigerated merchandising cabinet comprises an insulated casing, an interior of which forms a product display chamber. Refrigeration apparatus for generating and delivering a cold airstream through the product display chamber to cool the product display chamber is mounted on top of the casing. Access doors are mounted at a front of the casing to provide access to the product display chamber. Each access door is mounted on the casing by means of an inner frame forming an integral part of the casing and defining an access opening at the front of the casing and a complementary outer frame which is demountably engaged with the inner frame. Each door is hingedly mounted on the outer frame.

18 Claims, 11 Drawing Sheets

(56) References Cited

U.S. PATENT DOCUMENTS

| | | | | |
|---|---|---|---|---|
| 6,701,739 | B2 * | 3/2004 | Morse | F25D 21/14 62/448 |
| 8,998,354 | B2 * | 4/2015 | Wach | A47F 3/0434 312/138.1 |
| 2001/0003408 | A1 * | 6/2001 | Otto | F25D 27/00 312/401 |
| 2002/0021062 | A1 | 2/2002 | Hodges | |
| 2011/0126569 | A1 | 6/2011 | Selin et al. | |
| 2018/0146798 | A1 | 5/2018 | Artwohl et al. | |
| 2019/0072313 | A1 | 3/2019 | Grenier et al. | |
| 2019/0112866 | A1 * | 4/2019 | Baquet | A47F 3/0434 |

OTHER PUBLICATIONS

Search Opinion for European Patent Application No. 20193150 by European Patent Office dated Dec. 17, 2020.

* cited by examiner

DOOR ARRANGEMENT FOR REFRIGERATED MERCHANDISING CABINET

CROSS REFERENCE TO RELATED APPLICATIONS

This application claims priority to United Kingdom Patent Application No. GB 1912269.6 filed Aug. 27, 2019, the entire contents of which are incorporated herein by reference.

FEDERALLY SPONSORED RESEARCH AND DEVELOPMENT

None.

BACKGROUND OF THE INVENTION

1. Field of the Invention

This invention relates to a refrigerated merchandising cabinet, and in particular to an upright refrigerated merchandising cabinet of the type used in retail outlets to display chilled or frozen food products for sale.

2. Background

A refrigerated display case is disclosed in US2018/146798A1 entitled Thermal Frame by Artwohl et al. which has a door mounting frame having an inner thermally insulating part and an outer part of a thermally conductive metal with a metal sealing plate between the inner part and the outer part against which a door seals. Mounting brackets secure the frame on the cabinet body. Various door arrangements for refrigerated display cases are disclosed in EP1908376A2 entitled A Refrigerated Display Case Door and Method of Manufacture by Bienick, JP2017127352A entitled Door for Showcase by Takaoka et al., U.S. Pat. No. 4,852,303A entitled Refrigerator Door Frame with Insulated Mullion by Rolek, U.S. Pat. No. 5,255,473A entitled Refrigerator Door Assembly with Stylized Substantially all Glass Front by Kaspar et al., and US2019/072313A1 entitled Insulated Door and Refrigerator Door System Including the Insulated Door by Grenier et al. Refrigerated display cases with means for preventing condensate occurring at the doors are disclosed in U.S. Pat. No. 6,301,913B1 entitled Anti-Sweat Heater Improvement for Commercial Refrigeration by Schulak et al. and CN102379580B entitled Anti-Condensing Closed-Type Display Cabinet by Zhou et al.

The present invention is directed towards providing an improved refrigerated merchandising cabinet.

SUMMARY OF THE INVENTION

According to the invention, there is provided an upright refrigerated merchandising cabinet, including an insulated casing forming a product display chamber, refrigeration apparatus for generating and delivering a cold airstream through the product display chamber for cooling the product display chamber, at least one access door mounted at a front of the casing to provide access to an interior of the product display chamber, wherein each access door is mounted on the casing by means of an inner frame forming an integral part of the casing and defining an access opening at a front of the casing and a complementary outer frame which is demountably engaged with the inner frame, the or each access door being mounted on the outer frame.

In one embodiment of the invention, complementary interengagable formations are provided on the inner frame and on the outer frame for releasably engaging the inner frame and the outer frame.

In another embodiment of the invention, the complementary interengagable formations comprise a re-entrant slot in one of the inner frame and the outer frame, and an associated male connector on the other of the inner frame and the outer frame for releasable snap engagement in the re-entrant slot.

In another embodiment of the invention, the complementary interengagable formations comprise a re-entrant slot in the inner frame and an associated male connector on the outer frame for releasable snap engagement in the re-entrant slot.

In another embodiment of the invention, a heating element is mounted on the outer frame.

In another embodiment of the invention, a frame seal element is mounted on the outer frame, the frame seal element extending outwardly from the outer frame to engage an inside face of the door mounted on the outer frame.

In another embodiment of the invention, an endless door seal is mounted on an inside face of the door engaging between the inside face of the door and an outside face of the outer frame.

In another embodiment of the invention, a magnet and an associated magnetic strip are provided, one of the magnet and the magnetic strip being mounted on the door seal and the other of the magnet and the magnetic strip being mounted on the outer frame for cooperation to urge the door into a closed position.

In another embodiment of the invention, the inner frame includes at least one mullion sub-dividing the access opening at the front of the casing into two or more door openings.

In another embodiment of the invention, each mullion comprises an insulation foam filled plastics outer shell with metal reinforcement.

In another embodiment of the invention, the metal reinforcement comprises a steel stiffener mounted on an inner wall of the mullion.

In another embodiment of the invention, the steel stiffener has a T-shape, having a flat head portion mounted against the inner wall and a forwardly extending flange on the head portion.

In another embodiment of the invention, the steel stiffener comprises a folded metal plate.

In another embodiment of the invention, side edges of the steel stiffener engage within associated mounting slots on the inner wall.

In another embodiment of the invention, the inner frame forms a front face of the casing.

In another embodiment of the invention, the inner frame has clamp elements at each side for reception of front edges of inner and outer metal skins of the casing.

In another embodiment of the invention, the outer frame is of plastics material.

In another embodiment of the invention, each door has a multi-glazed viewing window.

In another embodiment of the invention, the refrigeration apparatus is mounted on top of the casing on an exterior of the casing sitting on a top wall of the casing and communicating with an interior of the casing through an associated opening in the top wall of the casing.

In another embodiment of the invention, the refrigeration apparatus comprises two or more demountable refrigeration units, each refrigeration unit mounted at an associated opening in the top wall of the casing, there being provided a separate opening in the top wall of the casing for each refrigeration unit.

In another embodiment of the invention, a well is formed in the product display chamber beneath a lower sill of each door.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The invention will be more clearly understood by the following description of some embodiments thereof, given by way of example only, with reference to the accompanying drawings.

DETAILED DESCRIPTION OF THE INVENTION

Figure 1:
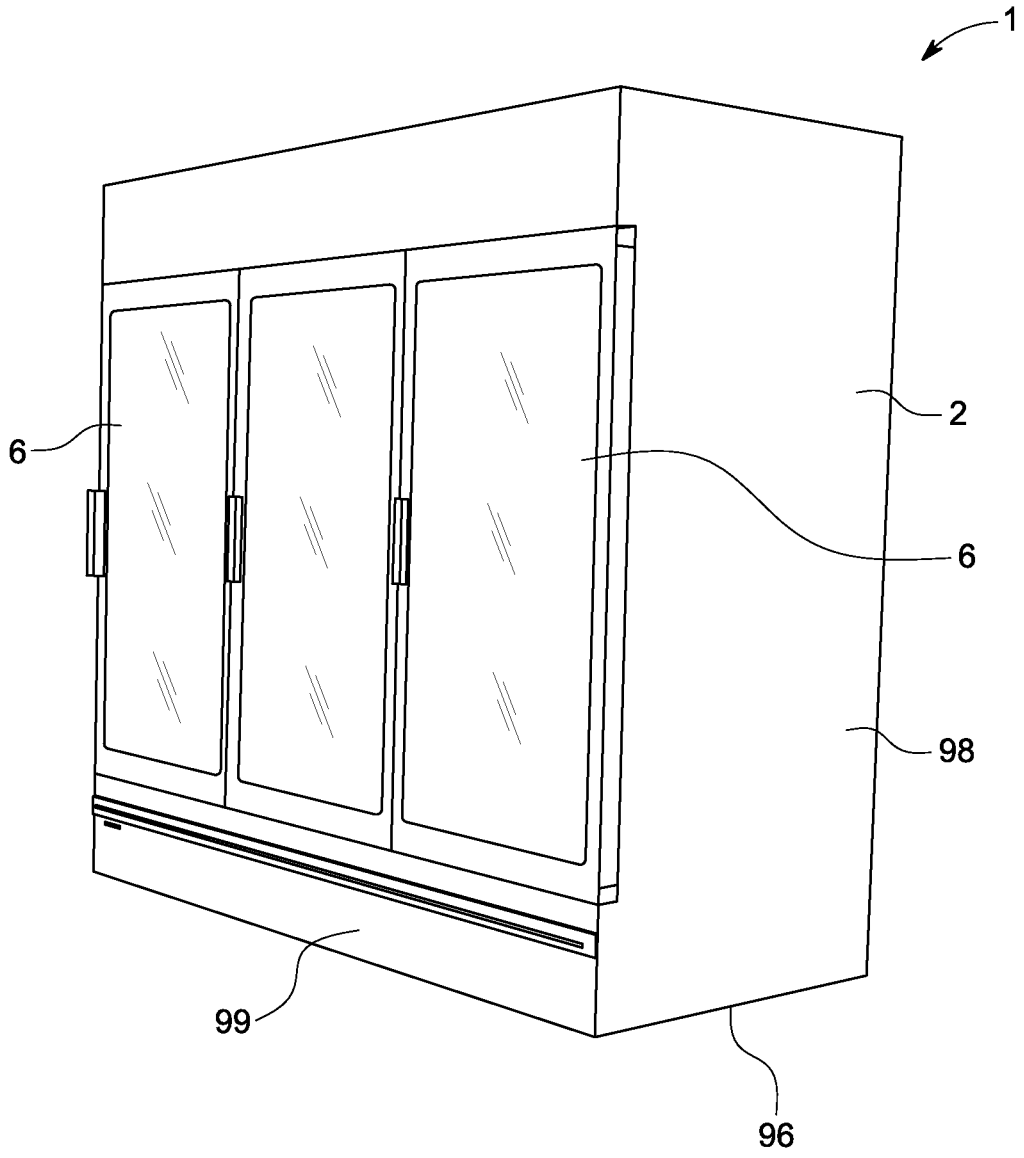
FIG. 1 is a perspective view of an upright refrigerated merchandising cabinet according to the invention.
Figure 2:
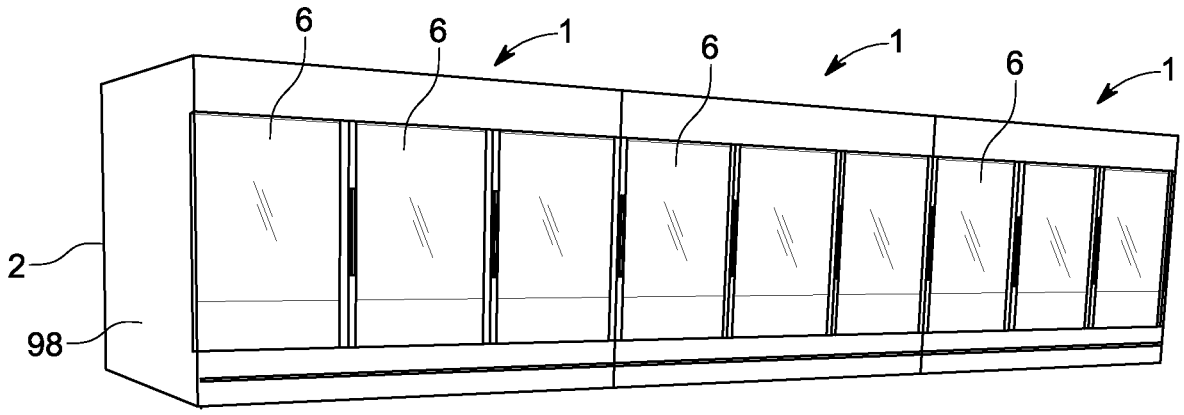
FIG. 2 is a perspective view of a number of the upright refrigerated merchandising cabinets arranged end to end to form a product display.

Referring to the drawings, and initially to FIGS. 1 to 10 thereof, there is illustrated an upright refrigerated merchandising cabinet according to the invention, indicated generally by the reference numeral 1. The refrigerated merchandising cabinet 1 comprises an insulated casing 2, an interior of which forms a product display chamber 3. Refrigeration apparatus 4 for generating and delivering a cold airstream through the product display chamber 3 to cool the product display chamber 3 is mounted on top of the casing 2. Three access doors 6 are mounted at a front of the casing 2 to provide access to the product display chamber 3. Each access door 6 is mounted on the casing 2 by means of an inner frame 10 forming an integral part of the casing 2 and defining an access opening 11 at the front of the casing 2 and a complementary outer frame 12 which is demountably engaged with the inner frame 10. Each door 6 is hingedly mounted on the outer frame 12.

Figure 6:
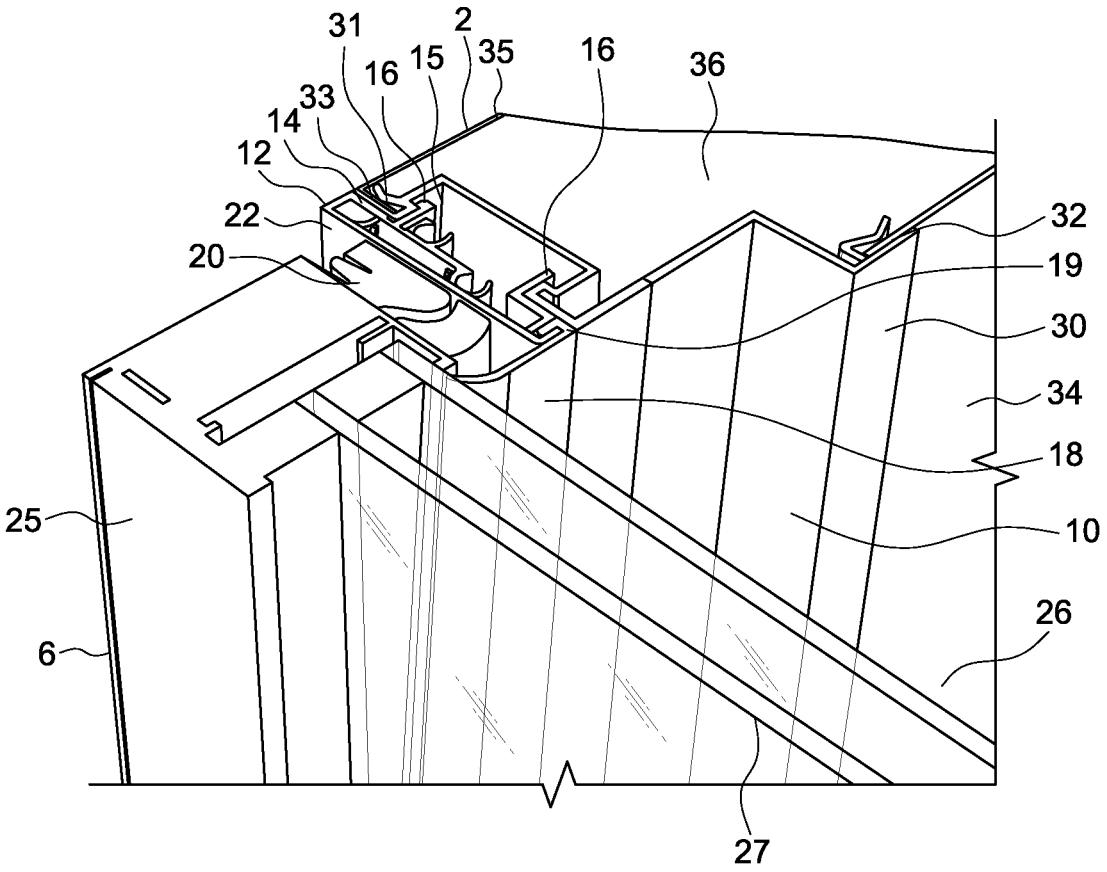
FIG. 6 is an enlarged detail perspective view showing portion of a door mounting frame on the cabinet.
Figure 7:
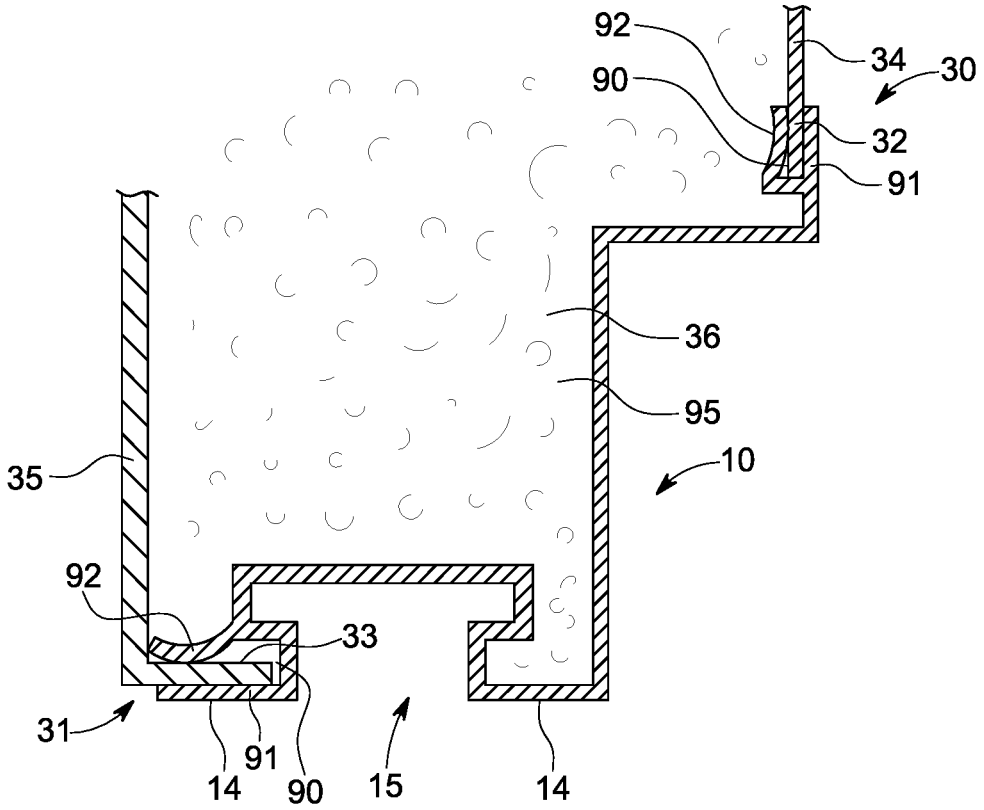
FIG. 7 is an enlarged detail sectional view showing portion of the door mounting frame.

Referring in particular to FIG. 6, each of the inner frame 10 and the outer frame 12 are constructed from elements of extruded plastics material. The inner frame 10 has a front wall 14 with a re-entrant slot 15. A complementary male connector 16 on the outer frame 12 projects into and snap engages within the re-entrant slot 15, as shown in FIG. 6. In this way, the outer frame 12 is demountably engaged with the inner frame 10.

A resilient frame seal element 18 is mounted on the outer frame 12 and clamped at its inner end 19 between the front wall 14 of the inner frame 10 and the outer frame 12. The frame seal element 18 extends outwardly from the outer frame 12 to engage an inside face of the access door 6. An outer free end 80 of the frame seal element 18 has an arcuate shape, extending outwardly across the outer frame 12. An endless door seal 20 is mounted on an inside face of the door 6 and engages between the inside face of the door 6 and an outside face 22 of the outer frame 12.

Figure 8:
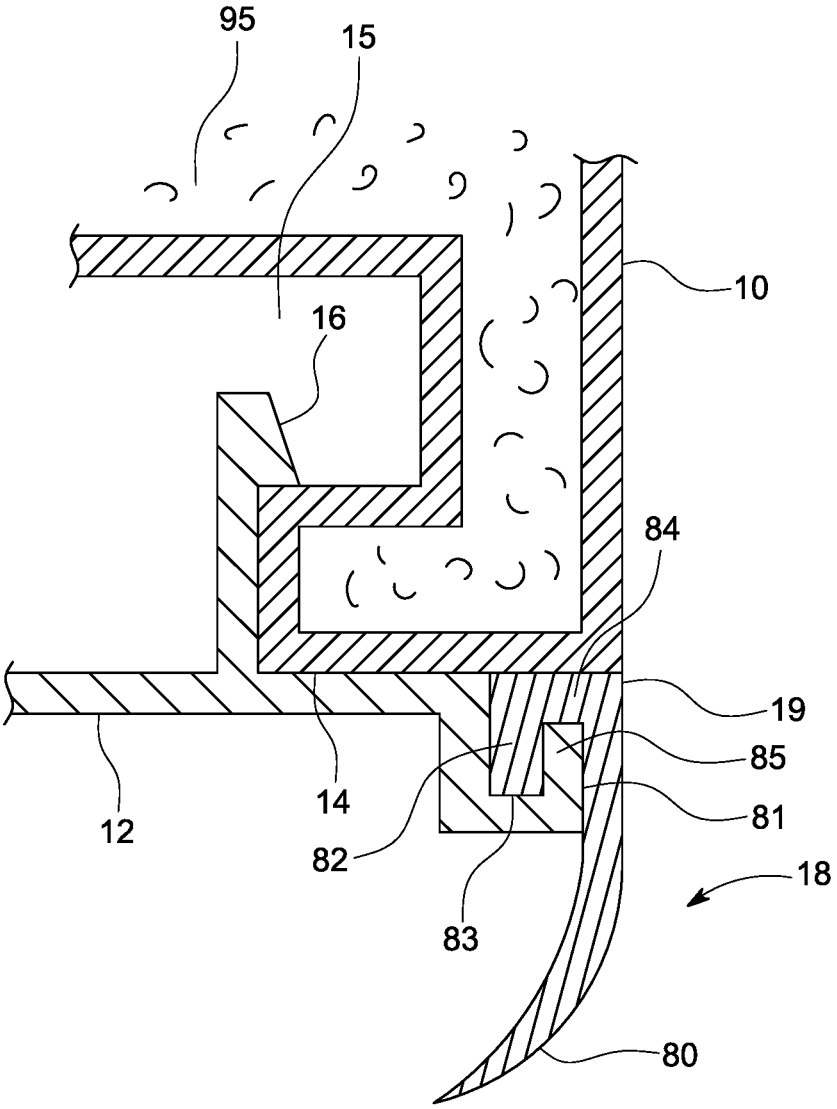
FIG. 8 is an enlarged detail sectional view showing portion of the door mounting frame.

Referring in particular to FIG. 8 it will be noted that the inner end 19 of the frame seal element 18 has a channel 81 with an inner lip 82 which seats within an associated groove 83 in the outer frame 12. An inner end 84 of the channel 81 is trapped against the front wall 14 of the inner frame 10 by an outer flange 85 of the groove 83 to securely clamp the inner end 19 of the frame seal element 18 between the inner frame 10 and the outer frame 12.

Each door 6 comprises a rectangular frame 25 mounting a pair of spaced-apart glazing panels 26, 27 of transparent glass or plastics material to allow a clear view of the product display chamber 3 and the products supported and displayed therein.

The inner frame 10 has clamp elements 30, 31 at each side for reception of front edges 32, 33 of an inner metal skin 34 and an outer metal skin 35 of the casing 2. Each clamp element 30, 31 has a socket 90 for reception of the metal skin 34, 35 of the casing 2. One side of the socket 90 has an outer straight jaw 91 and an opposite side of the socket 90 is formed by a resilient arcuate jaw 92 spaced-apart from the straight jaw 91 for reception and clamping of the front edges 32, 33 therebetween. The front end 33 of the outer metal skin 35 is turned inwardly to seat within the socket 90 of the clamp element 31. Thus, the inner frame 10 essentially forms a front face of the casing 2 around a periphery of the access opening 11. A void 36 between the inner metal skin 34 and outer metal skin 35 is filled with a foam insulation material 95.

Figure 5:
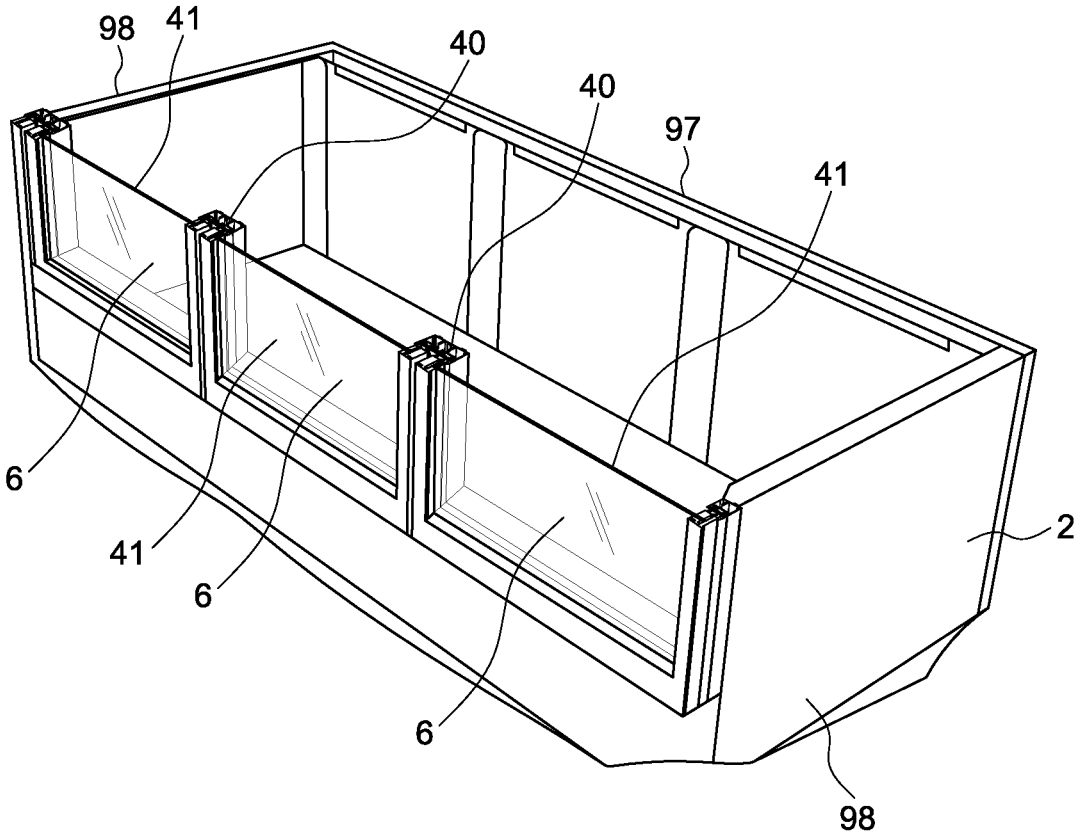
FIG. 5 is a detail sectional perspective view showing a lower portion of the refrigerated merchandising cabinet.
Figure 9:
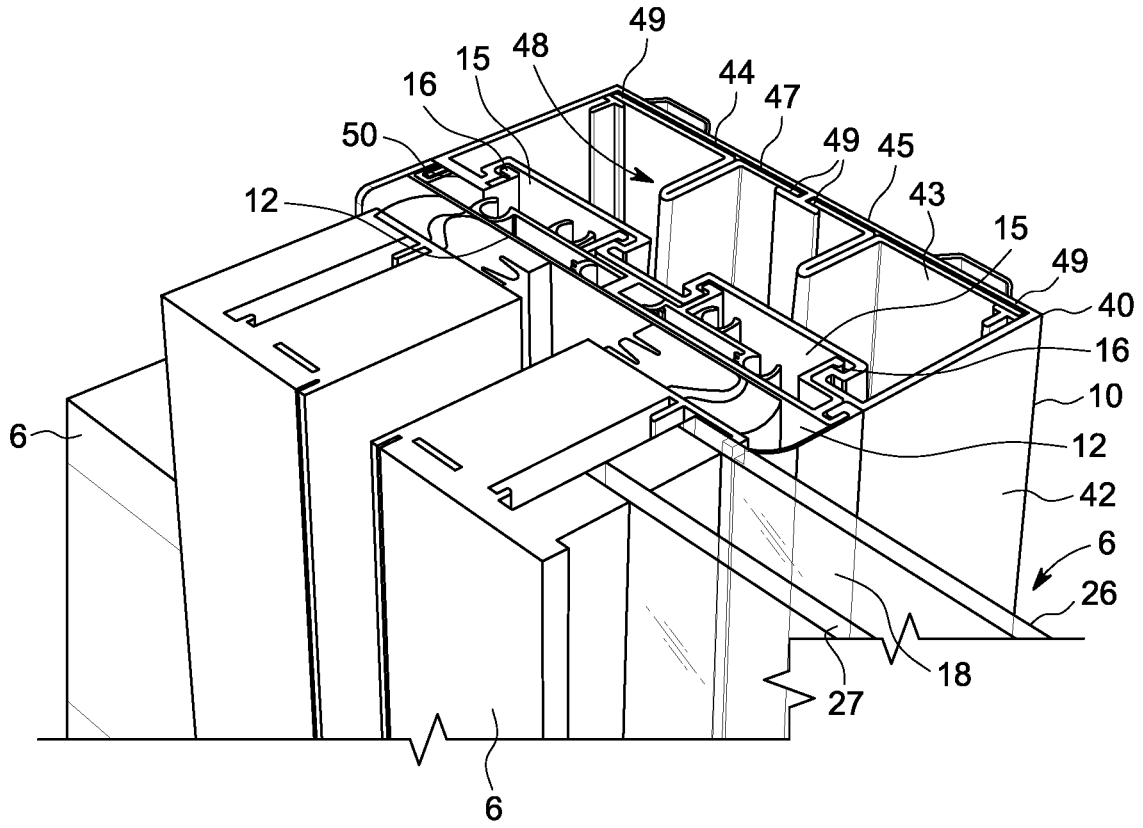
FIG. 9 is an enlarged detail perspective view showing portion of the door mounting frame.
Figure 10:
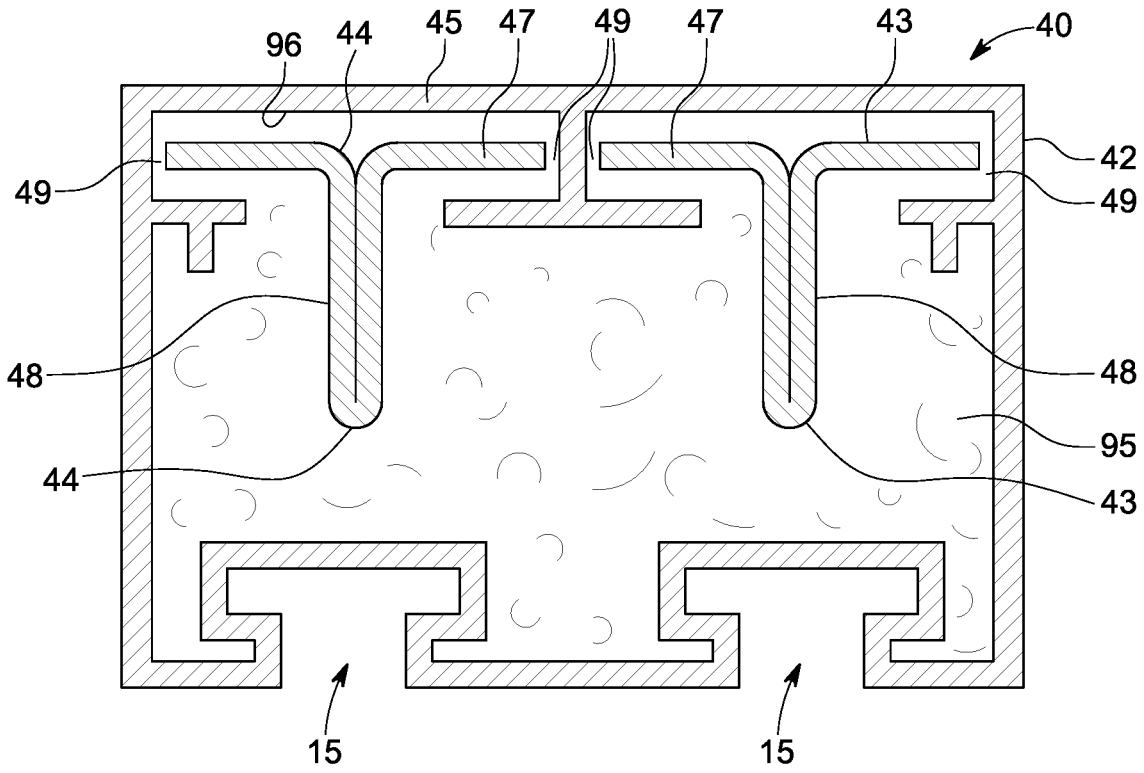
FIG. 10 is an enlarged detail sectional view showing portion of a mullion of the door mounting frame.

Referring in particular to FIG. 5, FIG. 9 and FIG. 10, the inner frame 10 has a pair of spaced-apart mullions 40 which sub-divide the access opening 11 into three door openings 41. Each mullion 40 comprises a plastics outer shell 42 of generally rectangular section, in-filled with insulation foam material 95. A pair of steel stiffeners 43, 44 are mounted on an inside face 96 of an inner wall 45 of the mullion 40. Each steel stiffener 43, 44 has a T-shape having a flat head portion 47 mounted against the inner wall 45 and a forwardly extending flange 48 on the head portion 47. Each steel stiffener 43, 44 may conveniently be formed by a folded metal plate as shown in FIG. 10. Each steel stiffener 43, 44 slidably engages within associated mounting slots 49 at the inner wall 45. The flanges 48 are substantially perpendicular to the inner wall 45.

A front wall 50 of the mullion 40 has a pair of spaced-apart re-entrant slots 15, each for reception of an associated male connector 16 on outer frames 12 associated with each door 6 which engages the mullion 40.

Figure 3:
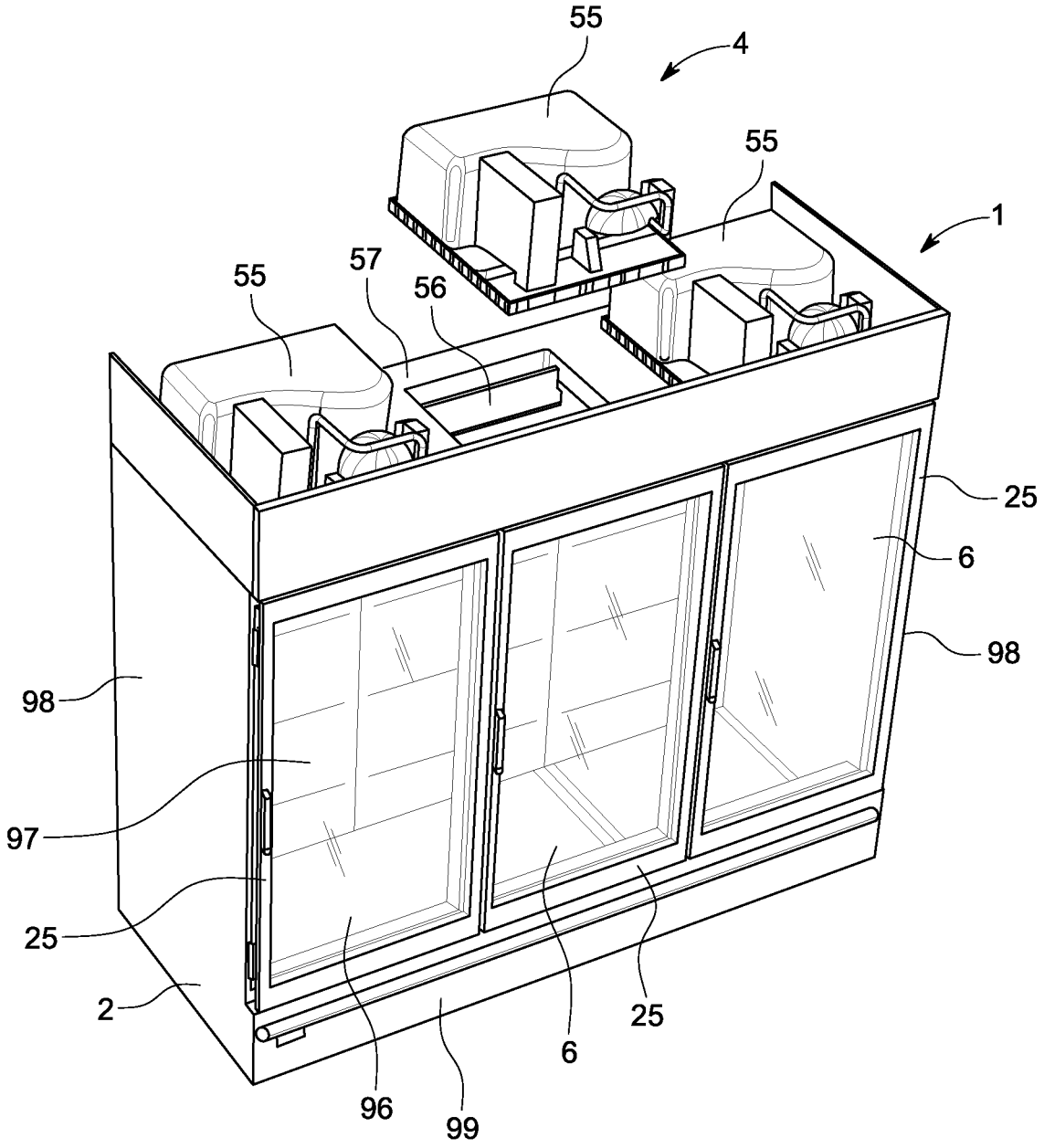
FIG. 3 is a partially exploded perspective view of the refrigerated merchandising cabinet.
Figure 4:
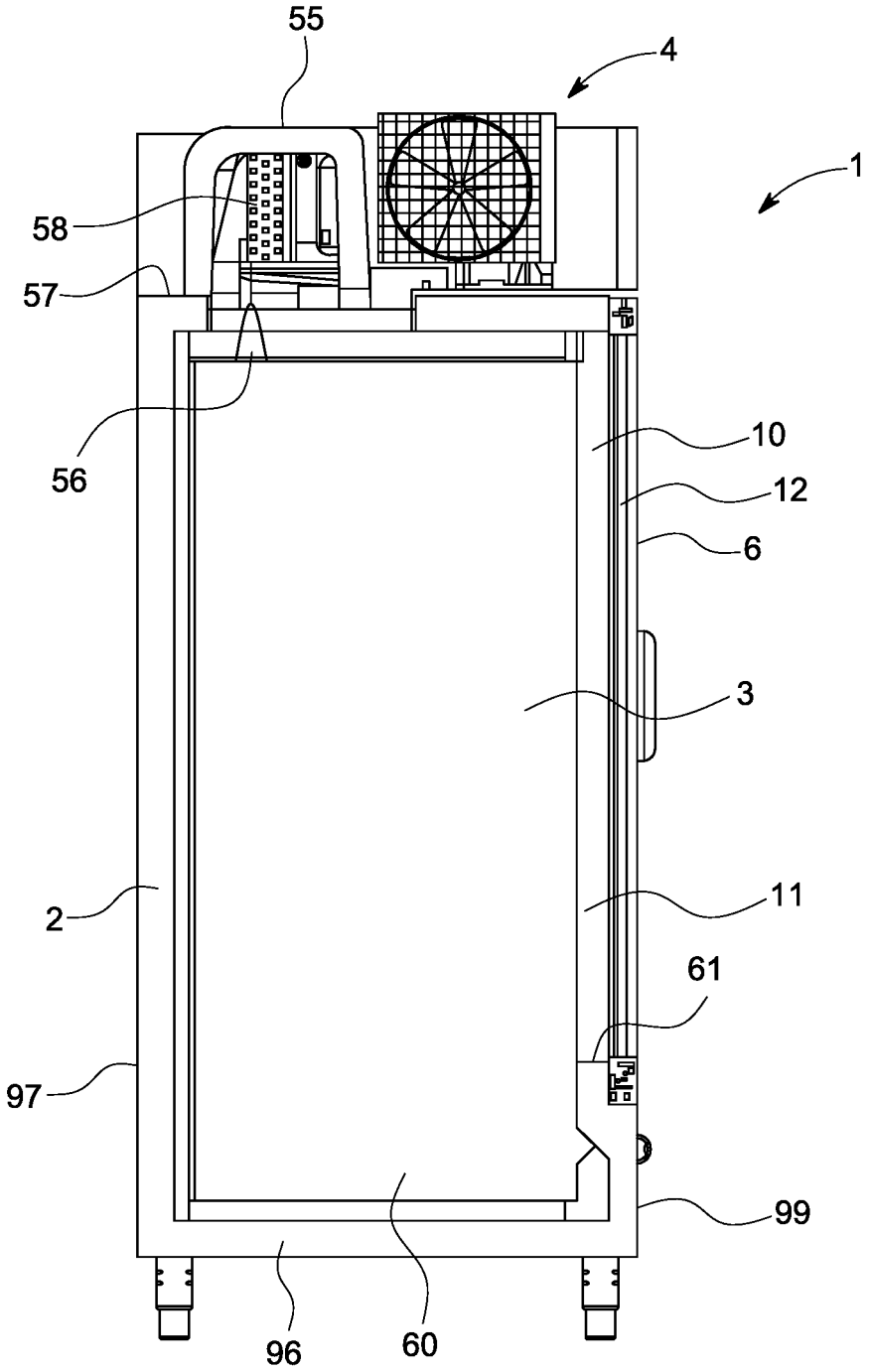
FIG. 4 is a sectional elevational view of the refrigerated merchandising cabinet.

Referring in particular to FIG. 3 and FIG. 4, the refrigeration apparatus 4 is mounted on top of the casing 2 on an exterior of the casing 2 sitting on a top wall 57 of the casing 2 and communicating with the interior of the casing 2 forming the product display chamber 3 through associated openings 56 in the top wall 57 of the casing 2. The refrigeration apparatus 4 comprises three demountable refrigeration units 55 each of which sits on top of an associated opening 56 in a top wall 57 of the casing 2, there being provided three separate spaced-apart openings 56 in the top wall 57 of the casing 2, that is a separate opening 56 for each refrigeration unit 55. A cold airstream is delivered from an evaporator 58 of each refrigeration unit 55 through the associated opening 56 in the top wall 57 of the casing 2 into the product display chamber 3. It will be appreciated that if any of the refrigeration units 55 should fail, it can be easily and quickly replaced. A well 60 is formed within the product chamber 3 beneath a lower sill 61 of each door 6.

The insulated casing 2 has a rectangular base 96 with an upstanding rear wall 97 and upstanding side walls 98 on the base 96 interconnected at their upper ends by the top wall 57. A low front wall 99 extends upwardly from the base 96 at a front of the base 96 at lower ends of the side walls 98 to form the well 60 at a bottom of the product display chamber 3 with the base 96, rear wall 97 and side walls 98.

In use, the refrigeration apparatus 4 is operated to maintain a cold climate within the product display chamber 3. Shelving (not shown) supports chilled or frozen products within the product display chamber 3 of the refrigerated merchandising cabinet 1 which can be clearly viewed by customers through the glazed doors 6 and retrieved by the customer by means of the glazed doors 6 as required. The inner frame 10 and outer frame 12 construction provides a very thermally efficient refrigerated merchandising cabinet 1. Also, the fact that the outer frame 12 is demountably secured on the inner frame 10 greatly facilitates maintenance of the cabinet 1. Although not shown in FIGS. 1 to 7, the outer frame 12 carries a heating element which helps to prevent condensation at the door 6. Such heating elements may fail from time to time, and if so, with the construction of the present invention, they are readily easily accessed and replaced, as required.

Figure 11:
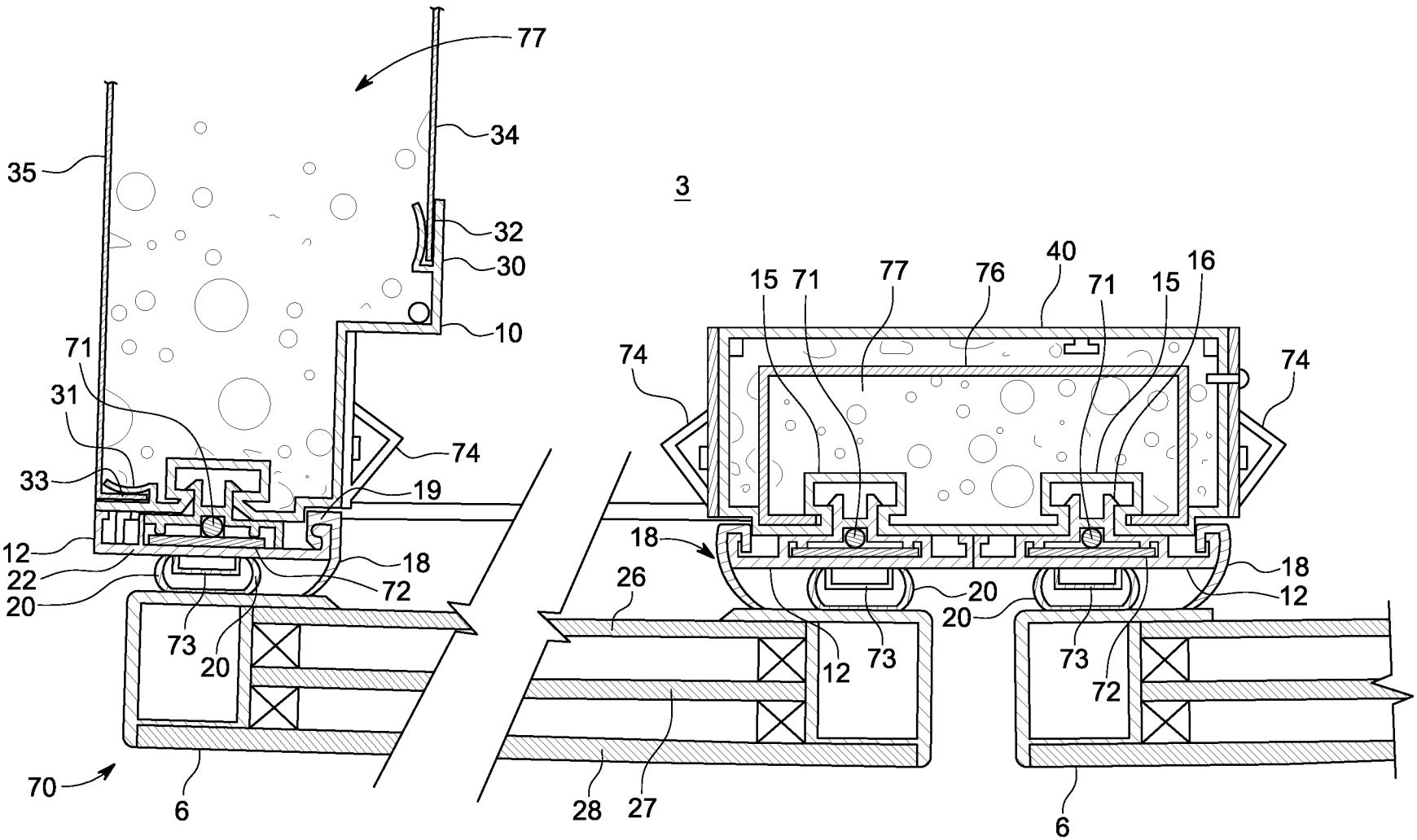
FIG. 11 is detail plan sectional view of portion of another upright refrigerated merchandising cabinet according to a second embodiment of the invention.

Referring now to FIG. 11, there is illustrated portion of another upright refrigerated merchandising cabinet, indicated generally by the reference numeral 70. Parts similar to those described previously are assigned the same reference numerals. A heating element 71 is shown mounted on the outer frame 12. Also shown is a metal strip 72 mounted on the outer frame 12 for cooperation with a magnet 73 mounted on the door seal 20. The magnetic strip 72 and magnet 73 cooperate to urge the door 6 into a closed position. In this case, each door 6 is triple glazed having three glazing panels 26, 27, 28. LED profiles 74 are mounted at each side of the door opening to direct light inwardly into the product display chamber 3. Each mullion 40 has a different arrangement whereby a steel stiffener 76 is embedded within insulating foam 77 contained within the mullion 40.

The terms "comprise" and "include", and any variations thereof required for grammatical reasons, are to be considered as interchangeable and accorded the widest possible interpretation.

The invention is not limited to the embodiments hereinbefore described which may be varied in both construction and detail within the scope of the appended claims.

What is claimed is:

1. An upright refrigerated merchandising cabinet comprising:

an insulated casing forming a product display chamber;

a refrigeration apparatus for generating and delivering a cold airstream through the product display chamber for cooling the product display chamber;

at least one access door mounted at a front of the casing to provide access to an interior of the product display chamber, the at least one access door being mounted on the casing by means of an inner frame forming an integral part of the casing and defining an access opening at the front of the casing; and a complementary outer frame which is demountably engaged with the inner frame, the at least one access door being mounted on the outer frame;

wherein:

the inner frame including at least one mullion subdividing the access opening at the front of the casing into two or more door openings;

the at least one mullion comprising an insulation foam filled plastics outer shell with metal reinforcement;

the metal reinforcement comprising a steel stiffener mounted on an inner wall of the mullion;

the steel stiffener has a T-shape, having a flat head portion mounted against the inner wall and a forwardly extending flange on the head portion.

2. The upright refrigerated merchandising cabinet as claimed in claim 1, wherein complementary interengagable formations are provided on the inner frame and on the outer frame for releasably engaging the inner frame and the outer frame.

3. The upright refrigerated merchandising cabinet as claimed in claim 2, wherein the complementary interengagable formations comprise a re-entrant slot in the inner frame and an associated male connector on the outer frame for releasable snap engagement in the re-entrant slot.

4. The upright refrigerated merchandising cabinet as claimed in claim 1, wherein a heating element is mounted on the outer frame.

5. The upright refrigerated merchandising cabinet as claimed in claim 1, wherein a frame seal element is mounted on the outer frame, the frame seal element extending outwardly from the outer frame to engage an inside face of the door mounted on the outer frame.

6. The upright refrigerated merchandising cabinet as claimed in claim 1, wherein the steel stiffener comprises a folded metal plate.

7. The upright refrigerated merchandising cabinet as claimed in claim 1, wherein side edges of the steel stiffener engage within associated mounting slots on the inner wall.

8. The upright refrigerated merchandising cabinet as claimed in claim 1, wherein the inner frame forms a front face of the casing.

9. The upright refrigerated merchandising cabinet as claimed in claim 8, wherein the inner frame has clamp elements at each side for reception of front edges of inner and outer metal skins of the casing.

10. The upright refrigerated merchandising cabinet as claimed in claim 1, wherein the outer frame is of plastics material.

11. The upright refrigerated merchandising cabinet as claimed in claim 1, wherein an endless door seal is mounted on an inside face of the at least one access door engaging between the inside face of the at least one access door and an outside face of the outer frame.

12. The upright refrigerated merchandising cabinet as claimed in claim 11, wherein a magnet and an associated magnetic strip are provided, one of the magnet and the magnetic strip being mounted on the door seal and the other of the magnet and the magnetic strip being mounted on the outer frame for cooperation to urge the at least one access door into a closed position.

13. The upright refrigerated merchandising cabinet as claimed in claim 1, wherein the refrigeration apparatus is mounted on top of the casing on an exterior of the casing sitting on a top wall of the casing and communicating with an interior of the casing through an associated opening in the top wall of the casing.

14. The upright refrigerated merchandising cabinet as claimed in claim 13, wherein the refrigeration apparatus comprises two or more demountable refrigeration units, each refrigeration unit mounted at an associated opening in the top wall of the casing, there being provided a separate opening in the top wall of the casing for each refrigeration unit.

15. The upright refrigerated merchandising cabinet as claimed in claim 1, wherein a well is formed in the product display chamber beneath a lower sill of the at least one access door.

16. The upright refrigerated merchandising cabinet as claimed in claim 1, wherein the at least one access door has a multi-glazed viewing window.

17. An upright refrigerated merchandising cabinet comprising:

an insulated casing forming a product display chamber;

a refrigeration apparatus for generating and delivering a cold airstream through the product display chamber for cooling the product display chamber;

at least one access door mounted at a front of the casing to provide access to an interior of the product display chamber, the at least one access door being mounted on the casing by means of an inner frame forming an integral part of the casing and defining an access opening at the front of the casing; and a complementary outer frame which is demountably engaged with the inner frame, the at least one access door being mounted on the outer frame;

wherein:

the inner frame including at least one mullion subdividing the access opening at the front of the casing into two or more door openings;

the at least one mullion comprising an insulation foam filled plastics outer shell with metal reinforcement;

the metal reinforcement comprising a steel stiffener mounted on an inner wall of the mullion;

the steel stiffener comprises a folded metal plate.

18. An upright refrigerated merchandising cabinet comprising:

an insulated casing forming a product display chamber;

a refrigeration apparatus for generating and delivering a cold airstream through the product display chamber for cooling the product display chamber;

at least one access door mounted at a front of the casing to provide access to an interior of the product display chamber, the at least one access door being mounted on the casing by means of an inner frame forming an integral part of the casing and defining an access opening at the front of the casing; and a complementary outer frame which is demountably engaged with the inner frame, the at least one access door being mounted on the outer frame;

wherein:

the inner frame including at least one mullion subdividing the access opening at the front of the casing into two or more door openings;

the at least one mullion comprising an insulation foam filled plastics outer shell with metal reinforcement;

the metal reinforcement comprising a steel stiffener mounted on an inner wall of the mullion;

side edges of the steel stiffener engage within associated mounting slots on the inner wall.

* * * * *